US007854572B2

(12) United States Patent
Lei

(10) Patent No.: US 7,854,572 B2
(45) Date of Patent: Dec. 21, 2010

(54) PILING MACHINE WITH HIGH-PRESSURE JET SPIRAL BIT AND ITS PILING METHOD

(76) Inventor: Yuhua Lei, Huazhengzhuangyuan, No. 499, Danjiang Road, Tanggu Marine Hi-New Tech Development Area, Tianjin (CN) 300451

( * ) Notice: Subject to any disclaimer, the term of this patent is extended or adjusted under 35 U.S.C. 154(b) by 0 days.

(21) Appl. No.: 12/499,174

(22) Filed: Jul. 8, 2009

(65) Prior Publication Data

US 2009/0274522 A1 Nov. 5, 2009

Related U.S. Application Data

(63) Continuation of application No. PCT/CN2007/003603, filed on Dec. 14, 2007.

(30) Foreign Application Priority Data

Jan. 8, 2007 (CN) ..... 2007 1 0056418

(51) Int. Cl.
*E02D 5/34* (2006.01)

(52) U.S. Cl. ..... 405/241; 405/233; 405/236; 405/239; 405/248

(58) Field of Classification Search ..... 405/241, 405/240, 236, 233, 248, 252.1, 253, 254
See application file for complete search history.

(56) References Cited

U.S. PATENT DOCUMENTS 4,496,011 A * 1/1985 Mazo et al. ..... 405/240
4,504,173 A * 3/1985 Feklin ..... 405/241
5,399,056 A * 3/1995 Shibazaki et al. ..... 405/233
5,722,498 A * 3/1998 Van Impe et al. ..... 405/241
6,033,152 A * 3/2000 Blum ..... 405/241
6,183,166 B1 * 2/2001 Schellhorn ..... 405/241
6,283,231 B1 * 9/2001 Coelus ..... 405/241
6,824,331 B2 * 11/2004 Parker ..... 405/241
7,198,434 B2 * 4/2007 Blum ..... 405/241
2006/0013656 A1 * 1/2006 Blum ..... 405/241

FOREIGN PATENT DOCUMENTS

CN 1370893 * 9/2002

* cited by examiner

*Primary Examiner*—Frederick L Lagman
(74) *Attorney, Agent, or Firm*—Matthias Scholl P.C.; Matthias Scholl

(57) ABSTRACT

A piling machine with high-pressure jet spiral bit, including an underpan, a pile frame, a drill pipe, a drill bit having an upper leaf helix, a lower leaf helix and a middle leaf helix, a power system, a high-pressure concrete casting system and a high-pressure jet grouting system. The drill bit is disposed at the head of the drill pipe and has multiple nozzles disposed thereon, a diameter of the middle leaf helix is constant from the top to the bottom thereof, a diameter of each of the upper leaf helix and the lower leaf helix decreases from the top to the bottom thereof so that the drill bit with upper and lower tines is formed, the drill bit is spiral, the high-pressure jet grouting system is disposed in the drill bit, and the nozzles are disposed on the drill bit. A piling method is also taught herein.

8 Claims, 4 Drawing Sheets

PILING MACHINE WITH HIGH-PRESSURE JET SPIRAL BIT AND ITS PILING METHOD

CROSS-REFERENCE TO RELATED APPLICATIONS

This application is a continuation of International Patent Application No. PCT/CN2007/003603 with an international filing date of Dec. 14, 2007, designating the United States, now pending, and further claims priority benefits to Chinese Patent Application No. 200710056418.4, filed on Jan. 8, 2007. The contents of these specifications are incorporated herein by reference.

BACKGROUND OF THE INVENTION

1. Field of the Invention

The invention relates to a piling machine and a method, and more particularly to a piling machine with a high-pressure jet spiral bit and a piling method.

2. Description of the Related Art

Piling machines are widely used in construction of pile foundation such as buildings, bridges, municipal engineering, water resources, dock projects and so on. For current spiral drills, diameters of all parts thereof are the same except for the drill bits, and for long spiral drills, a length of the spiral portion is the same as that of a pile, which causes large revolving resistance. Therefore, in construction of large-diameter and long piles, high power or decreased piling length and diameter are required, and thus it cannot meet design requirements. For short spiral drills, although the spiral portion is short, several times are required for the drill bits to entirely enter soils and the short spiral drills cannot be used in soft soils. For coastal muddy clay, the spiral drills cannot be used since clay soils are difficult to be cleaned. In driving piles using spiral drills with lead-in pipes, it is difficult to pull the lead-in pipes out and the cost is very high. China patent number ZL200410094076.1 discloses a piling method, comprising pulling soils in a drill hole out from the ground using spiral portions on the spiral drills and then cleaning the soils.

Therefore, the current long and short spiral drills, drills with lead-in pipes, drill holes and piling machines have disadvantages in terms of techniques, carrying capability, cost and so on, especially in geological places such as coastal mud, muddy clay, powdery clay, places difficult in forming retaining walls by fine sands, and sedimentary rocks.

SUMMARY OF THE INVENTION

In view of the above-described problems, it is one objective of the invention to provide a piling machine that is suitable for different geological conditions and capable of entering deep hard clay, meets different requirements for bearing capacity and needs no lead-in pipe and excavation of retaining walls.

It is another objective of the invention to provide a piling method that is suitable for different geological conditions and capable of entering deep hard clay, meets different requirements for bearing capacity and needs no lead-in pipe and excavation of retaining walls.

To achieve the above objectives, in accordance with one embodiment of the invention, provided is a piling machine with a high-pressure jet spiral bit, comprising a moving system, an underpan, a pile frame, a power system, a drill pipe, a drill bit comprising an upper leaf helix, a lower leaf helix, and a middle leaf helix, a high-pressure concrete casting system, and a high-pressure jet grouting system, wherein the drill bit is disposed at the head of the drill pipe and comprises multiple nozzles disposed thereon, a diameter of the middle leaf helix is constant from the top to the bottom thereof, a diameter of each of the upper leaf helix and the lower leaf helix gradually decreases from the top to the bottom thereof so that the drill bit with upper and lower tines is formed, the drill bit is spiral, the high-pressure jet grouting system is disposed in the drill bit. In a class of this embodiment, the nozzles comprise multiple upper nozzles, middle nozzles and lower nozzles.

In a class of this embodiment, the upper nozzles are disposed at the top of the drill bit, the middle nozzles are disposed in the middle of the drill bit, and the lower nozzles are disposed at the bottom of the drill bit.

In a class of this embodiment, an upper port is disposed below the upper nozzle and operates to discharge mud, and a lower port is disposed above the lower nozzle and operates to discharge mud.

In a class of this embodiment, the drill pipe comprises an inner portion and an outer portion.

In a class of this embodiment, the inner portion of the drill pipe comprises a high-pressure concrete casting channel and a mud-discharging channel, and the mud-discharging channel is connected to the upper port and the lower port, the high-pressure jet grouting channel is disposed between the inner portion and the outer portion.

In a class of this embodiment, an upper nozzle channel, a middle nozzle channel and a lower nozzle channel are disposed in the high-pressure jet grouting channel.

In a class of this embodiment, the upper nozzle channel is connected to the upper nozzles, the middle nozzle channel is connected to the middle nozzles, and the lower nozzle channel is connected to the lower nozzles.

In a class of this embodiment, the high-pressure concrete casting system comprises a high-pressure concrete pump, a concrete-transmission pipe and a concrete-injection hole, the concrete-transmission pipe is received in the high-pressure concrete casting channel, the concrete-injection hole is disposed at the bottom of the drill bit, and the concrete is injected via the high-pressure concrete casting channel and the concrete-injection hole.

In a class of this embodiment, a stop valve is disposed on the leaf helix and operates to stop soil, and a multiple of teeth are disposed on the leaf helix.

In accordance with another embodiment of the invention, provided is a piling method, comprising providing a piling machine comprising a drill pipe comprising an inner portion with a high-pressure concrete casting channel and a mud-discharging channel and an outer portion, a drill bit comprising an upper leaf helix, a lower leaf helix and a middle leaf helix, a high-pressure concrete casting system comprising a high-pressure concrete pump, a concrete-transmission pipe and a concrete-injection hole, and a high-pressure jet grouting system, an upper port being disposed below the upper nozzle and a lower port being disposed above the upper nozzle and operating to discharge mud, and a piling hole, drilling into the soil via the drill bit and cutting the soil via the high-pressure jet grouting system so that the soil turns into mud, flows into the upper port and is then discharged via the mud-discharging channel, and pulling up the drill bit and starting the high-pressure concrete casting system, so that fluid concrete is injected into the piling hole via the high-pressure concrete casting channel and the concrete-injection hole and forms a pure-concrete pile body with a designed height.

In a class of this embodiment, it further comprises inserting a steel cage into the pure-concrete pile body before the concrete is initially set.

In a class of this embodiment, it further comprises cutting soil via the lower nozzle of the high-pressure jet grouting system so that soil turns into mud, flows into the lower port and is then discharged via the mud-discharging channel when it's difficult to drill the drill bit into the designed depth in powder sand-hard soil.

In a class of this embodiment, it further comprises spirally spraying cement grouting on the soil around the piling body via the middle nozzle, so that a cement soil pile with certain thickness is formed outside the concrete pile and surrounds a concrete core pile, and a combined pile is formed by the concrete core pile and the cement soil pile.

Advantages of the invention are summarized below:

1) in operation, the upper leaf helix of the spiral drill bit can be removed and only the drill pipe is remained, twisting force and resistance are decreased by 50-70% as the drill bit enters or is pulled out of the soil, and thus required power is greatly saved;
2) under the same power, a coil diameter of the drill bit and a length of the drill pipe can be increased so as to enable the piling machine to meet different construction requirements such as large bearing capacity, great diameter and great length;
3) a cylinder is formed by the soil between the upper leaf helixes and operates as a lead-in pipe and a retaining wall, as the drill pipe is pulled up, a piling hole is formed to makes it possible to inject concrete to cover the cylinder, and thus production cost is reduced;
4) as the piling machine enters the soil, the lower nozzle sprays and turns the soil into the mud, and then the mud flows into the lower port and is discharged via the mud-discharging channel; during concrete casting, the upper port discharges the mud so that the drill bit is pulled up and the piling hole is formed, and then the concrete is casted into a pile.

This not only solves a problem with conventional piling machines that the drill bit has to be pulled out so as to clean the soil, but also avoids pulling of the lead-in pipe.

To summarize, the piling machine with a high-pressure jet spiral bit of the invention solves problems existing in spiral grouted piles, grouted piles with lead-in pipes and retaining walls, and bored piles.

BRIEF DESCRIPTION OF THE DRAWINGS

The invention is described hereinafter with reference to accompanying drawings, in which.

Legend: 1. pile frame; 2. underpan; 3. moving system; 4. power system; 5. drill pipe; 6. high-pressure jet grouting system; 8. drill bit; 9. middle leaf helix; 10. upper leaf helix; 11. lower leaf helix; 12. concrete-injection hole; 13. high-pressure concrete casting channel; 14. high-pressure concrete pump; 15. concrete-transmission pipe; 16. mud-discharging channel; 17. high-pressure jet grouting channel; 18. upper nozzle channel; 19. lower nozzle channel; 20. upper nozzle; 21. middle nozzle; 22. lower nozzle; 23. upper port; 24. stop valve; 25. middle nozzle channel; 26. tooth; 27. lower port.

DETAILED DESCRIPTION OF THE EMBODIMENTS

Figure 1:
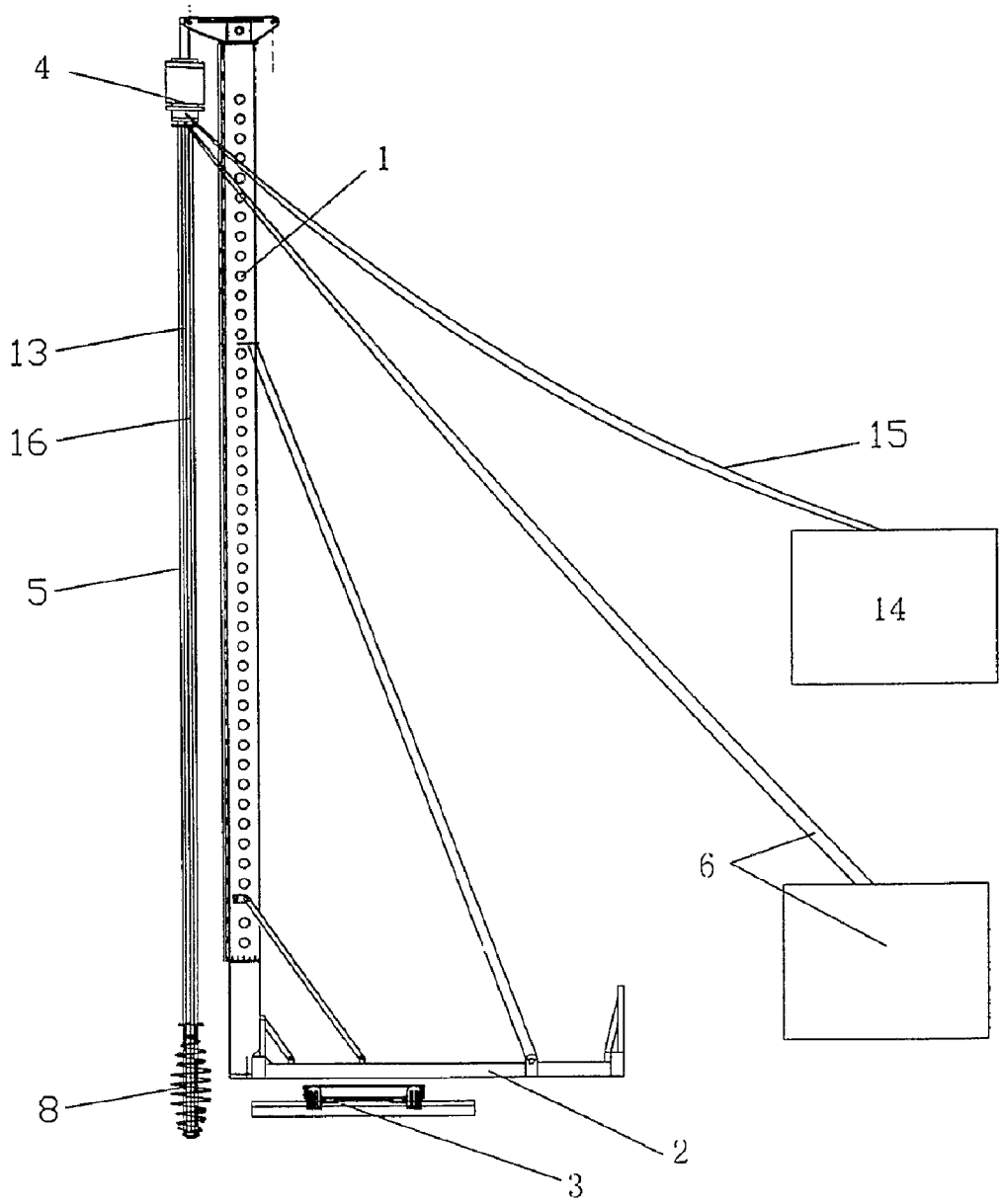
FIG. 1 is a schematic diagram of a piling machine of one embodiment of the invention.
Figure 2:
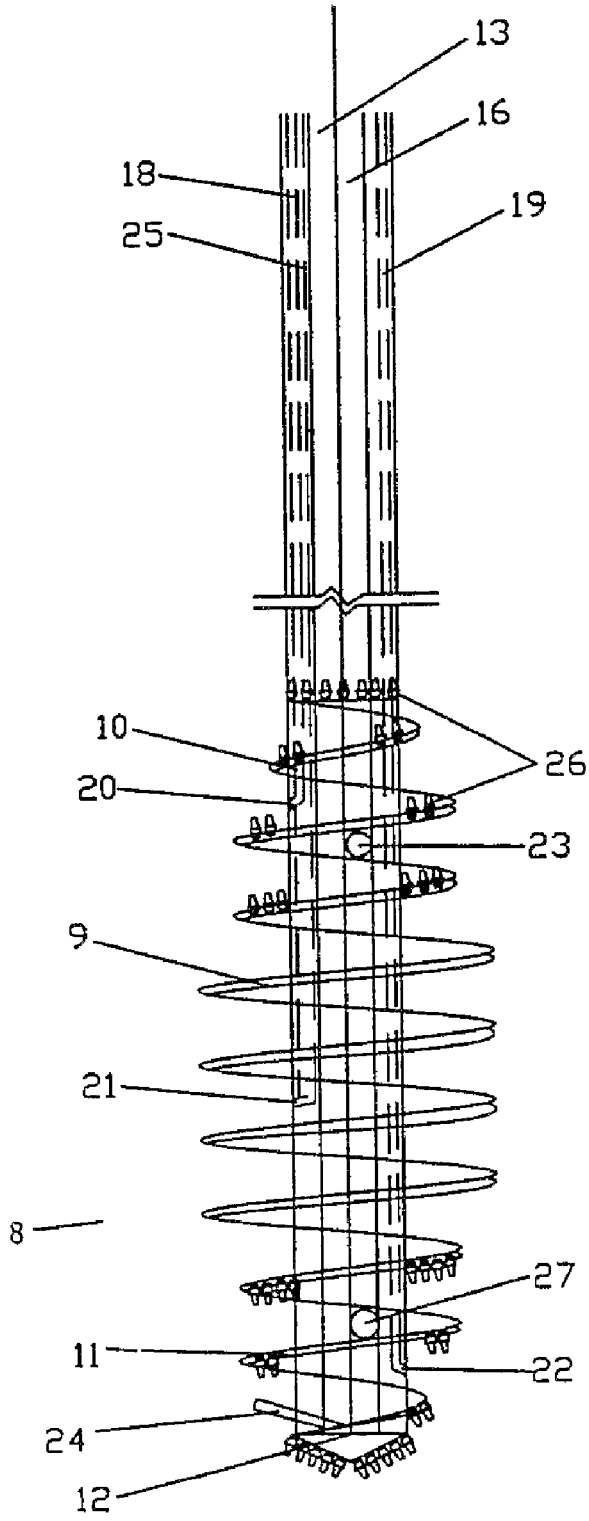
FIG. 2 is a schematic diagram of a spiral drill bit of one embodiment of the invention.

As shown in FIGS. 1 and 2, a piling machine with a high-pressure jet spiral bit of the invention comprises a moving system 3, a pile frame 1, an underpan 2, a power system 4, a drill pipe 5, a high-pressure jet grouting system 6, a drill bit 8, and a high-pressure concrete casting system.

The drill bit 8 is disposed at the head of the drill pipe 5, and comprises a middle leaf helix 9, an upper leaf helix 10 and a lower leaf helix 11. In this embodiment, the drill bit 8 is spiral.

The diameter of the middle leaf helix 9 is constant from the top to the bottom thereof, a diameter of each of the upper leaf helix 10 and the lower leaf helix 11 gradually decreases from the top to the bottom, so the drill bit 8 with upper and lower tines is formed. A length of the middle leaf helix 9 is 1-2 m.

An upper nozzle 20 is disposed at the head of the drill bit 8, a middle nozzle 21 is disposed in the middle of the drill bit 8, and a lower nozzle 22 is disposed at the bottom of the drill bit 8.

Figure 3:
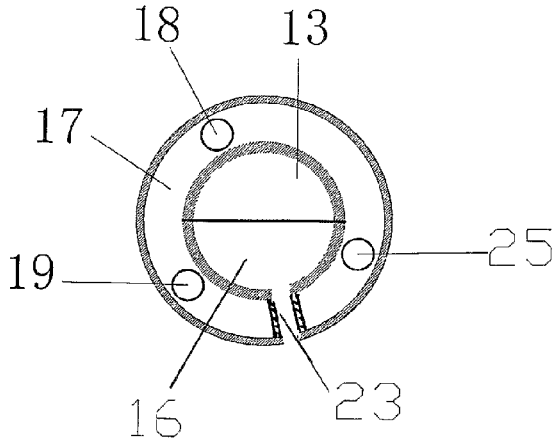
FIG. 3 is a sectional view of a drill pipe of one embodiment of the invention.

As shown in FIG. 3, an upper port 23 is disposed below the upper nozzle 20 and operates to discharge mud, and a lower port 27 is disposed above the lower nozzle 22 and operates to discharge mud.

The drill pipe 5 comprises an inner portion and an outer portion. The inner portion of the drill pipe 5 comprises a high-pressure concrete casting channel 13 and a mud-discharging channel 16, and the mud-discharging channel 16 is connected to the upper port 23 and the lower port 27. A high-pressure jet grouting channel 17 is disposed between the inner portion and the outer portion.

An upper nozzle channel 18, a middle nozzle channel 25 and a lower nozzle channel 19 are disposed in the high-pressure jet grouting channel 17. The upper nozzle channel 18 is connected to the upper nozzle 20, the middle nozzle channel 25 is connected to the middle nozzle 21, and the lower nozzle channel 19 is connected to the lower nozzle 22.

The high-pressure concrete casting system comprises a high-pressure concrete pump 14, a concrete-transmission pipe 15 and a concrete-injection hole 12. The concrete-transmission pipe 15 is received in the high-pressure concrete casting channel 13, the concrete-injection hole 12 is disposed at the bottom of the drill bit 8, and the concrete is injected via the high-pressure concrete casting channel 13 and the concrete-injection hole 12.

A stop valve 24 is disposed on the leaf helix and operates to stop soil when the drill bit 8 reverses, and a multiple of teeth 26 is disposed on the leaf helix and operate to break soil.

Figure 4:
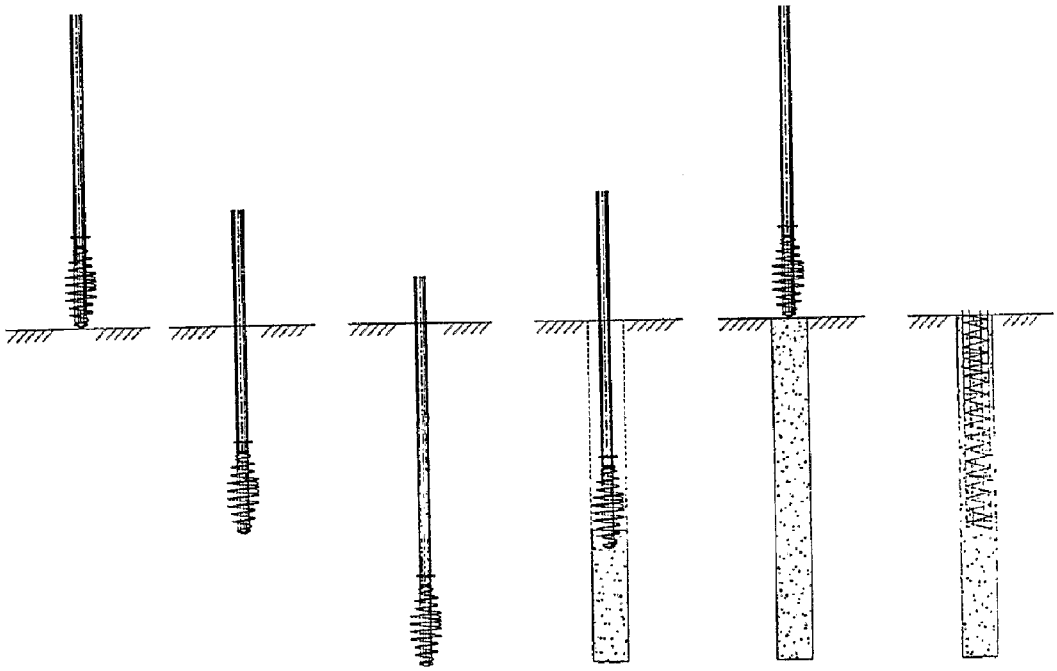
FIG. 4 is a flow chart of a piling method using a piling machine of one embodiment of the invention.

As shown in FIG. 4, a piling method of the invention of one embodiment of the invention applicable to geological conditions of hard clay and liquid fine sand, comprises steps of:

(a) drilling into the soil via the drill bit, cutting soil via the lower nozzle of the high-pressure jet grouting system so that soil turns into mud, flows into the lower port and is then discharged via the mud-discharging channel if the drill bit cannot be drilled into the soil;
(b) cutting the soil via the high-pressure jet grouting system so that the soil turns into mud, flows into the upper port and is then discharged via the mud-discharging channel;
(c) pulling up the drill bit and starting the high-pressure concrete casting system, so that fluid concrete is injected into the piling hole via the high-pressure concrete casting channel and the concrete-injection hole and forms a pure-concrete pile body with a designed height; and
(d) inserting a steel cage into the pure-concrete pile body before the concrete is initially set.

It should be noted that if the drill bit is easily drilled into the soil, the above-mentioned step (a) can be omitted.

Figure 5:
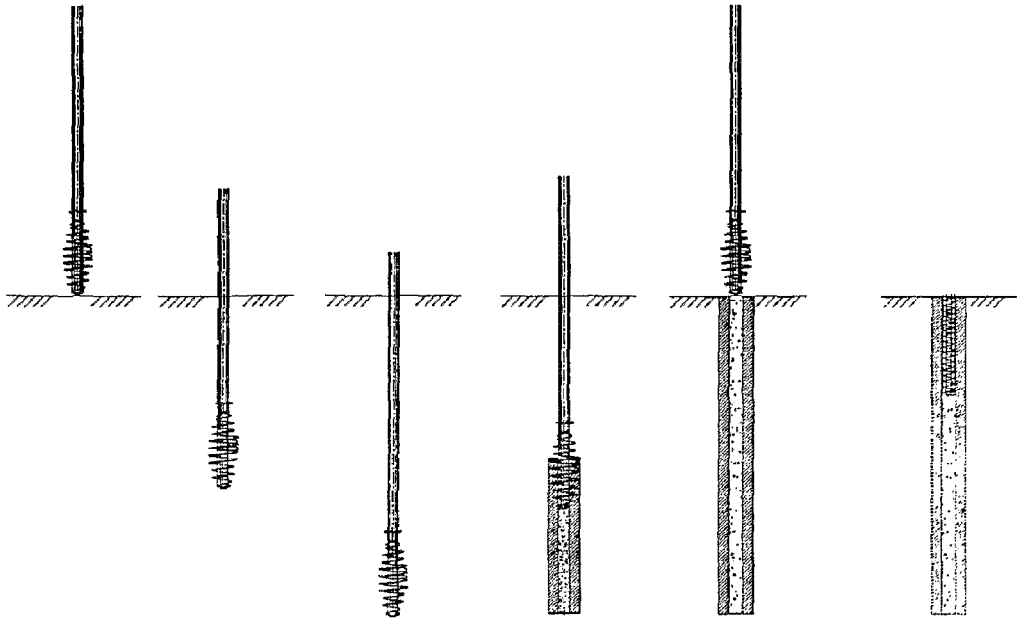
FIG. 5 is a flow chart of another piling method using a piling machine of one embodiment of the invention.

As shown in FIG. 5, another piling method of the invention of another embodiment of the invention is applicable to forming a combined pile, and comprises steps of:

(a) drilling into the soil via the drill bit, cutting soil via the lower nozzle of the high-pressure jet grouting system so that soil turns into mud, flows into the lower port and is then discharged via the mud-discharging channel if the drill bit cannot be drilled into the soil;

(b) cutting the soil via the high-pressure jet grouting system so that the soil turns into mud, flows into the upper port and is then discharged via the mud-discharging channel;

(c) pulling up the drill bit and starting the high-pressure concrete casting system, so that fluid concrete is injected into the piling hole via the high-pressure concrete casting channel and the concrete-injection hole, and synchronously and spirally spraying cement grouting on the soil around the piling body via the middle nozzle, so that a cement soil pile with certain thickness is formed outside the concrete pile and surrounds a concrete core pile, and a combined pile is formed by the concrete core pile and the cement soil pile; and (d) inserting a steel cage into the pure-concrete pile body before the concrete is initially set.

It should be noted that if the drill bit is easily drilled into the soil, the above-mentioned step (a) can be omitted.

Since the concrete core pile and the cement soil pile form a combined pile, the concrete core pile bears upper loads, and the (circular) cement soil pile increases side friction of the concrete core pile and lateral resisting-force. The invention improves carrying capability of the core pile by 30-100% or above, and features high economic benefit.

For powdery soils and fine sands with high density, in case that a large-diameter pile is required and squeezing soils and forming holes are difficult, the invention uses the high-pressure jet grouting system to break the soil and generate mud, and enables the mud to be discharged via the mud-discharging channel. When the drill is pulled upwardly, the jet grouting system injects cement grouting into the hole to form a pile.

By way of the high-pressure jet grouting system, it is able to spray cement grouting or other materials capable of reinforcing soil mass around the pile so as to improve density and strength of the soils around the pile and to increase vertical bearing capacity and lateral resisting-force thereof.

The piling method of the invention can also be applied to trenchless pipe-laying.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A piling machine with a high-pressure jet spiral bit, comprising:

a moving system;

an underpan;

a pile frame;

a power system;

a drill pipe;

a drill bit, comprising: an upper leaf helix, a lower leaf helix, and a middle leaf helix;

a high-pressure concrete casting system; and a high-pressure jet grouting system;

wherein said drill bit is disposed at the head of said drill pipe and comprises multiple nozzles disposed thereon;

said upper leaf helix tapers from a smaller diameter to a larger diameter from the top to the bottom thereof, said middle leaf helix has a constant diameter, and said lower leaf helix tapers from a larger diameter to a smaller diameter from the top to the bottom thereof so that the drill bit with upper and lower tines is formed;

said drill bit is spiral;

said high-pressure jet grouting system is disposed in said drill bit;

said nozzles comprise multiple upper nozzles, middle nozzles, and lower nozzles, said upper nozzles being disposed at the top of said drill bit, said middle nozzles being disposed in the middle of said drill bit, and said lower nozzles being disposed at the bottom of said drill bit;

an upper port is disposed below said upper nozzle and operates to discharge mud;

a lower port is disposed above said lower nozzle and operates to discharge mud;

said drill pipe comprises an inner portion and an outer portion;

said inner portion of said drill pipe comprises a high-pressure concrete casting channel and a mud-discharging channel;

said mud-discharging channel is connected to said upper port and said lower port;

a high-pressure jet grouting channel is disposed between said inner portion and said outer portion;

an upper nozzle channel, a middle nozzle channel and a lower nozzle channel are disposed in said high-pressure jet grouting channel;

said upper nozzle channel is connected to said upper nozzle;

said middle nozzle channel is connected to said middle nozzle; and said lower nozzle channel is connected to said lower nozzle.

2. The piling machine of claim 1, wherein said high-pressure concrete casting system comprises a high-pressure concrete pump, a concrete-transmission pipe and a concrete-injection hole;

said concrete-transmission pipe is received in said high-pressure concrete casting channel;

said concrete-injection hole is disposed at the bottom of said drill bit; and concrete is injected via said high-pressure concrete casting channel and said concrete-injection hole.

3. The piling machine of claim 1, wherein a stop valve and a multiple of teeth are disposed on said leaf helix.

4. A piling method, comprising providing a piling machine with a high-pressure jet spiral bit comprising a drill pipe comprising an inner portion with a high-pressure concrete casting channel and a mud-discharging channel and an outer portion, a drill bit comprising an upper leaf helix, a lower leaf helix and a middle leaf helix, a high-pressure concrete casting system comprising a high-pressure concrete pump, a concrete-transmission pipe and a concrete-injection hole, and a high-pressure jet grouting system, an upper port and a lower port being disposed below said upper nozzle and operates to discharge mud, and a piling hole;

drilling into the soil via said drill bit and cutting the soil via said high-pressure jet grouting system so that the soil turns into mud, flows into said upper port and is then discharged via said mud-discharging channel; and pulling up said drill bit and starting said high-pressure concrete casting system, so that fluid concrete is injected into said piling hole via said high-pressure concrete casting channel and said concrete-injection hole and forms a pure-concrete pile body with a designed height.

5. The piling method of claim 4, further comprising inserting a steel cage into said pure-concrete pile body before the concrete is initially set.

6. The piling method of claim 4, further comprising cutting soil via said lower nozzle of said high-pressure jet grouting system so that soil turns into mud, flows into said lower port and is then discharged via said mud-discharging channel if said drill bit cannot be drilled into the soil.

7. The piling method of claim 6, further comprising spirally spraying cement into the soil around said piling body via said middle nozzle, so that a cement soil pile with certain thickness is formed outside said concrete pile and surrounds a concrete core pile, and a combined pile is formed by said concrete core pile and said cement soil pile.

8. The piling method of claim 4, further comprising spirally spraying cement into the soil around said piling body via said middle nozzle, so that a cement soil pile with certain thickness is formed outside said concrete pile and surrounds a concrete core pile, and a combined pile is formed by said concrete core pile and said cement soil pile.

* * * * *